US007387461B2

(12) United States Patent
Brandt et al.

(10) Patent No.: US 7,387,461 B2
(45) Date of Patent: Jun. 17, 2008

(54) BINDER HAVING COMPARTMENT WITH SLOTTED ACCESS

(75) Inventors: Diane S. Brandt, Menlo Park, CA (US); Susan Rothstein, San Francisco, CA (US)

(73) Assignee: Captio Corporation, San Francisco, CA (US)

( * ) Notice: Subject to any disclaimer, the term of this patent is extended or adjusted under 35 U.S.C. 154(b) by 503 days.

(21) Appl. No.: 10/844,013

(22) Filed: May 11, 2004

(65) Prior Publication Data

US 2005/0254884 A1 Nov. 17, 2005

(51) Int. Cl.
*B42F 3/00* (2006.01)

(52) U.S. Cl. ..... 402/73; 281/31

(58) Field of Classification Search ..... 283/36, 283/38, 40, 41, 42, 43; 434/117; 281/15.1, 281/29, 31, 34; 402/73, 74, 76, 78
See application file for complete search history.

(56) References Cited

U.S. PATENT DOCUMENTS

| | | | | | |
|---|---|---|---|---|---|
| 818,202 | A * | 4/1906 | Sweet | 281/31 |
| 2,088,953 | A * | 8/1937 | Greer | 281/31 |
| 2,223,560 | A | 12/1940 | Friedlaender | |
| 2,318,110 | A * | 5/1943 | Sjobom | 281/31 |
| 2,852,275 | A | 9/1958 | Brook et al. | |
| 4,301,962 | A * | 11/1981 | Monckton et al. | 229/72 |
| 4,629,349 | A * | 12/1986 | Pitts | 402/74 |
| 5,030,027 | A | 7/1991 | Bachrach et al. | |
| 5,368,333 | A | 11/1994 | Arroyo | |
| 5,711,627 | A | 1/1998 | Chapman | |
| 5,857,797 | A | 1/1999 | Streff et al. | |
| 5,924,736 | A | 7/1999 | Russo | |
| 6,086,106 | A | 7/2000 | Joe et al. | |
| 6,241,414 | B1 | 6/2001 | Wien | |
| 6,247,729 | B1 | 6/2001 | Kaufman | |
| 6,488,433 | B2 * | 12/2002 | Wien et al. | 402/73 |
| 6,607,215 | B2 | 8/2003 | Nomura | |
| 6,837,346 | B2 * | 1/2005 | Hollingsworth | 190/11 |
| 7,021,853 | B2 * | 4/2006 | Hall et al. | 402/73 |
| 7,077,596 | B1 * | 7/2006 | Bianco et al. | 402/73 |
| 2003/0098578 | A1 * | 5/2003 | Moor | 281/31 |
| 2005/0207827 | A1 * | 9/2005 | Busam et al. | 402/73 |

FOREIGN PATENT DOCUMENTS

WO WO-9507787 A1 * 3/1995

* cited by examiner

*Primary Examiner*—Daniel W Howell
(74) *Attorney, Agent, or Firm*—Michael A. Glenn; Glenn Patent Group

(57) ABSTRACT

The invention provides an organizational system that comprises a form of workflow based upon a binder metaphor. The invention provides a binder that is organized internally along the line of most binders, e.g. with sleeves or dividers and a retention system, such as a three ring system for keeping track of information. Unique to the invention is the provision of a slotted front cover which leads to an internally accessible compartment. Uniquely, the invention allows an individual to stuff their bills and other information that requires timely attention through the slot in the binder. These items are retained securely therein in a closed compartment. The individual may on a timely basis, i.e. monthly, open the compartment within the binder and go through the various letters, bills, and like, and respond thereto in a coordinated way.

7 Claims, 4 Drawing Sheets

BINDER HAVING COMPARTMENT WITH SLOTTED ACCESS

BACKGROUND OF THE INVENTION

1. Technical Field

The invention relates to binders. More particularly, the invention relates to a binder having a compartment with a slotted access port.

2. Description of Prior Art

Binders are ubiquitous and invaluable organizational tools. A typical binder includes a front cover and back cover which defines inner area for storage of various materials. Binders can include rings or clips to hold these materials therein and can be organized into sections. Binders can include mechanism for closing. Examples of known binders include the following:

- U.S. Pat. No. 2,223,560 to Friedlander attaches a compartment to a binder page which is held by three split rings. A pair of flaps opens to allow ingress into the compartment;
- U.S. Pat. No. 2,852,275 to Brook teaches a label holder on the front page or the spine of the binder, the holder comprising of frame with a side (or top) slot to allow placement of the label, card, therein;
- U.S. Pat. No. 5,030,027 Bachrach et al., which teaches attaching a clear outer cover to the front of the binder, where the cover is attached to the front on three sides and opens on the top;
- U.S. Pat. No. 5,368,333 to Arroyo teaches attaching a hinged compartment to the spine of the binder;
- U.S. Pat. No. 5,771,627 to Chapman teaches a binder having an outer pocket that is open only at the top to each of the front, back, and spine of the binder;
- U.S. Pat. No. 5,857,797 to Streff, et al. teaches attaching a picture frame, only open at the top, to the front and spine of the binder;
- U.S. Pat. No. 5,924,726 to Russo provides a picture sleeve on the outer front surface of the binder with a sleeve closed on all edges, except the vertical edge adjacent to the spine;
- U.S. Pat. No. 6,086,106 to Joe et al. provides a double layer of transparent pockets, all open at their top edges, on the front or back of a binder;
- U.S. Pat. No. 6,241,414 to Wien teaches locating a plurality of pockets inside the binder. The pockets are open along one edge, either the top or one side thereof. The openings are closable by Velcro® or zippers;
- U.S. Pat. No. 6,247,729 to Kaufman teaches attaching a storage tube to one cover of the book. The tube is closed by caps or plugs; and
- U.S. Pat. No. 6,607,215 to Nomura teaches a scrapbook having a storage compartment on the front cover. Access to the compartment is through an open edge adjacent spine.

See, also, U.S. Pat. Nos. 6,099,187 and 6,200,057, which relate to the UniKeep™ binding system.

As can be seen from the forgoing, human ingenuity has created many variations on the basic theme of the binder to provide organizational tools adapted to various needs. Heretofore, no one has addressed the needs of an individual in the modern day, fraught as it is with such complex details. For example, the average person today must keep track of credit card bills, health insurance, rent, or mortgage payments, property insurance, and the like. Even young people (for example, college students) must track paperwork and information on a variety of topics. Most persons' attempts to organize the various documents that require regular attention are either ineffective, resulting in missed payments and late charges, or time consuming, i.e., maintaining a formal filing system.

Heretofore, no one has addressed the needs of an individual in the modern day, fraught as it is with complex details.

What is needed is a system, for example based upon a binder metaphor, that creates a work flow by which a person can organize and track those documents and data which are essential for maintaining a modern standard of living.

SUMMARY OF THE INVENTION

The invention provides an organizational system that comprises a form of workflow based upon a binder metaphor. Quite simply, the invention provides a binder that is organized internally along the line of most binders, e.g. with sleeves or dividers and a retention system, such as a three ring system for keeping track of information. Unique to the invention is the provision of a slotted front end which leads to an internally accessible compartment. Uniquely, the invention allows an individual to stuff their bills and other information that requires timely attention through the slot in the binder. These items are retained securely therein in a closed compartment. The individual may on a timely basis, i.e. monthly, open the compartment within the binder and go through the various letters, bills, and the like, and respond thereto in a coordinated way.

DETAILED DESCRIPTION OF THE INVENTION

The preferred embodiment of the invention is contemplated as being an all-in-one organizer, for example for college students. The invention addresses the issue of, for example, a credit card bill being due, but the individual being unable to locate it. The preferred embodiment of the invention includes a compartment that secures important pieces of paper within a binder that contains all records and vital information for a person's life. In use, as bills, bank statements, receipts and the like are received, they are slipped through the slot in the binder and secured therein in a compartment until the user is ready to access them. As discussed above, on a periodic basis, e.g. monthly, users can pay their bills, balance their checkbook, and file their paperwork.

Figure 1:
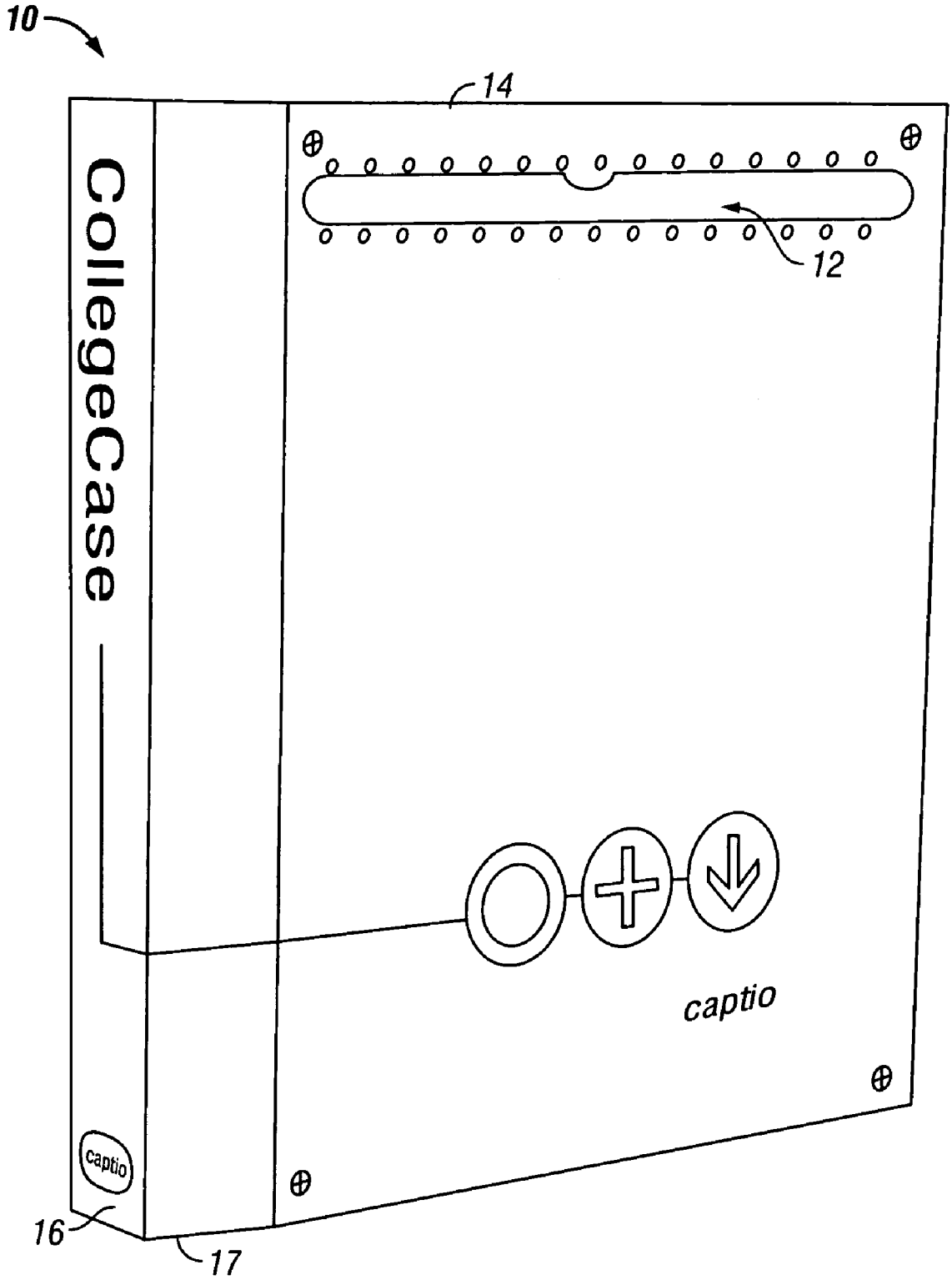
FIG. 1 is a perspective view of a binder having a slotted port for access to the internal compartment according to the invention.

FIG. 1 is a perspective view of a binder 10. The binder includes a spine 16, a front cover 14, and a back cover (which is not shown in FIG. 1), which are attached to the spine by means of hinges 17. Unique to the invention, is the provision is a slot 12 formed through the front cover and by which materials may be introduced into a compartment defined within the binder. Those skilled in the art will appreciate that while the slot is shown having a horizontal orientation through the front cover of the binder, the orientation may be vertical and the slot may be placed in the spine, or back cover of the binder as well.

Figure 2:
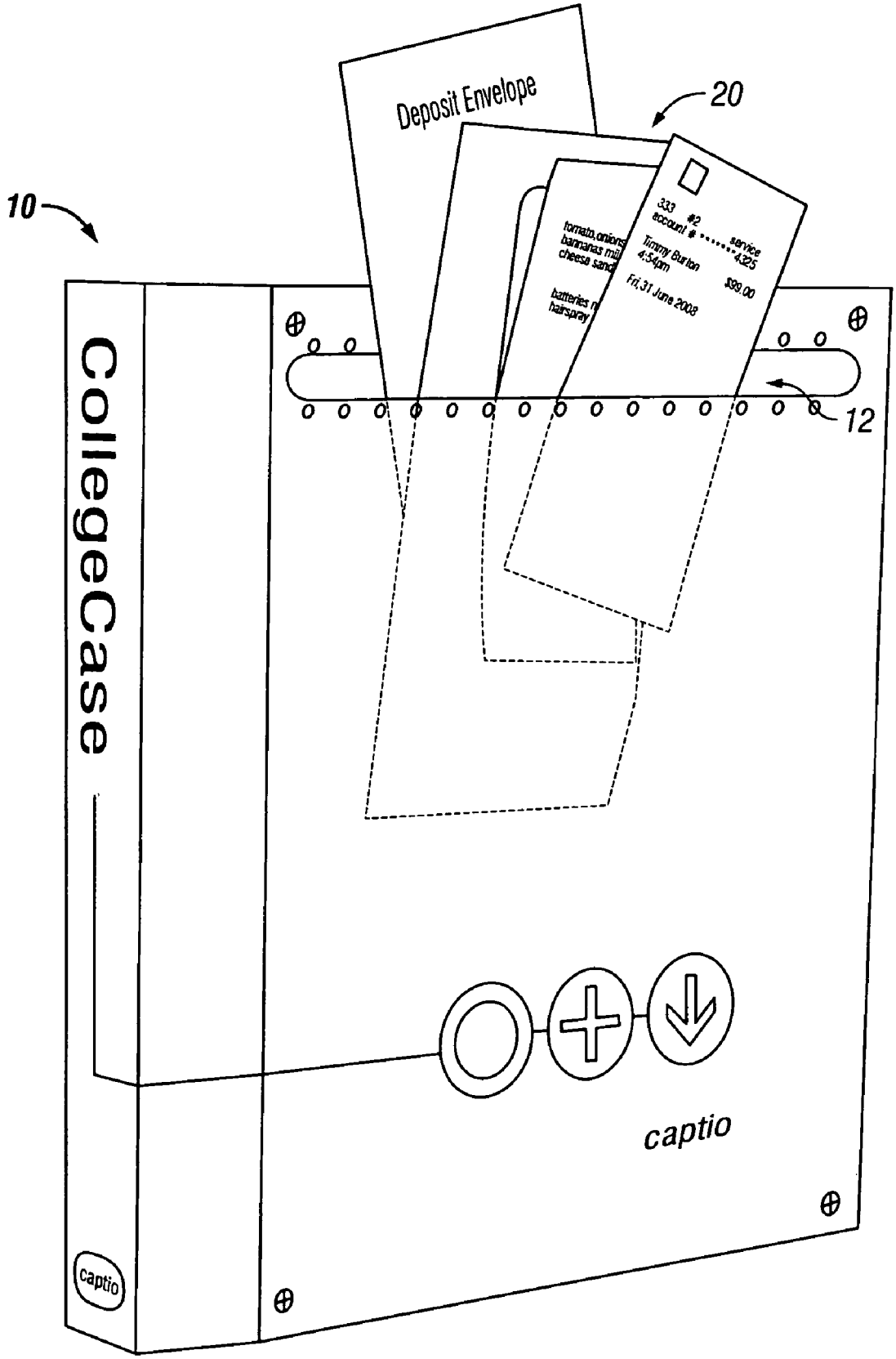
FIG. 2 is a perspective view of the binder showing the placement of various materials into the compartment within the binder through the slotted port.

FIG. 2 is a perspective view of the binder shown in FIG. 1. In FIG. 2, various materials 20, such as statements, bills, and the like, are shown being introduced into the compartment within the binder via the slot 12.

Figure 3:
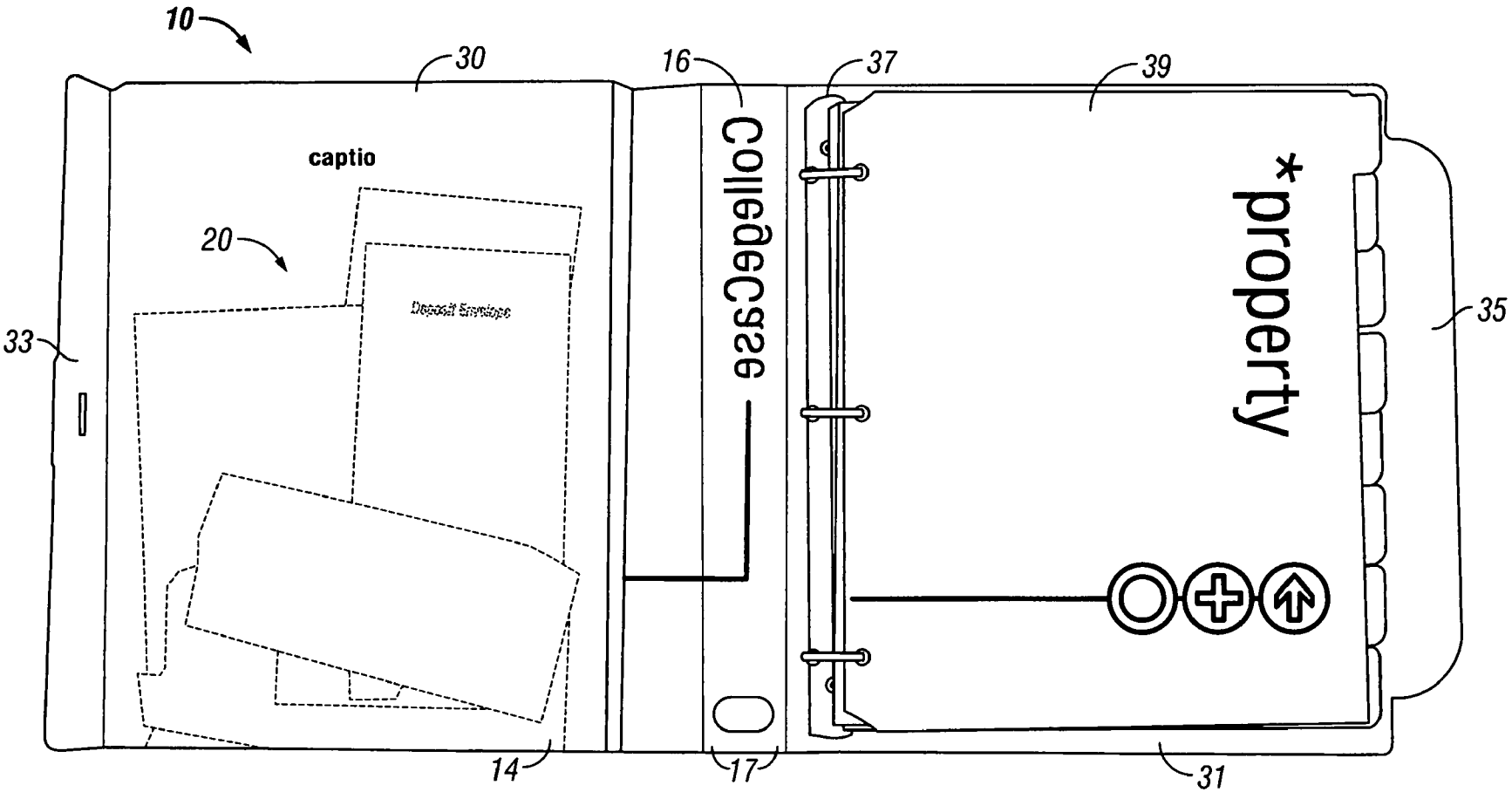
FIG. 3 is a perspective view of a binder showing an internal compartment within which various materials introduced into the compartment via the slot are secured.

FIG. 3 is a perspective view of the binder of FIG. 1 showing the binder in an open position. In FIG. 3, the binder includes a front cover 14 and a back cover 31, which are secured to a spine 16 by hinges 17. The binder includes a retention mechanism 37 which, in this example, is a commonly known three ring binding system, but which may be any kind of securing system if such system is provided with the binder. Those skilled in the art will appreciate that the binder may be provided with or without such securing means and the securing means need not be vertically oriented. For example, the securing means could be a clip having a horizontal orientation or could be rings having such orientation. The securing means holds various materials 39 in the binder. In the preferred embodiment, the materials are organized by sleeves or pockets, but dividers may be used as well. It is preferred that the organization system chosen be related to the function of the binder, which in the embodiment is the receipt and storage of bills, statements, and the like. Thus, a binder section maybe provided for such items such as rent, bank accounts, checking accounts, and the like.

The binder shown in FIG. 3 includes a mechanism for holding the binder in a closed configuration. Thus, when the binder closed, a flap 35 having an extension can mate with a complimentary flap 33 to secure the binder in a closed position. This mechanism can take any chosen form and is optional.

FIG. 3 also shows a compartment 30 that receives and retains items introduced through the slot 12 that is formed in the top cover 14 of the binder. The materials introduced through the slot, as shown in FIG. 2, are shown in phantom form in FIG. 3. These materials 20 can comprise such items as receipts, bills, and the like.

Figure 4:
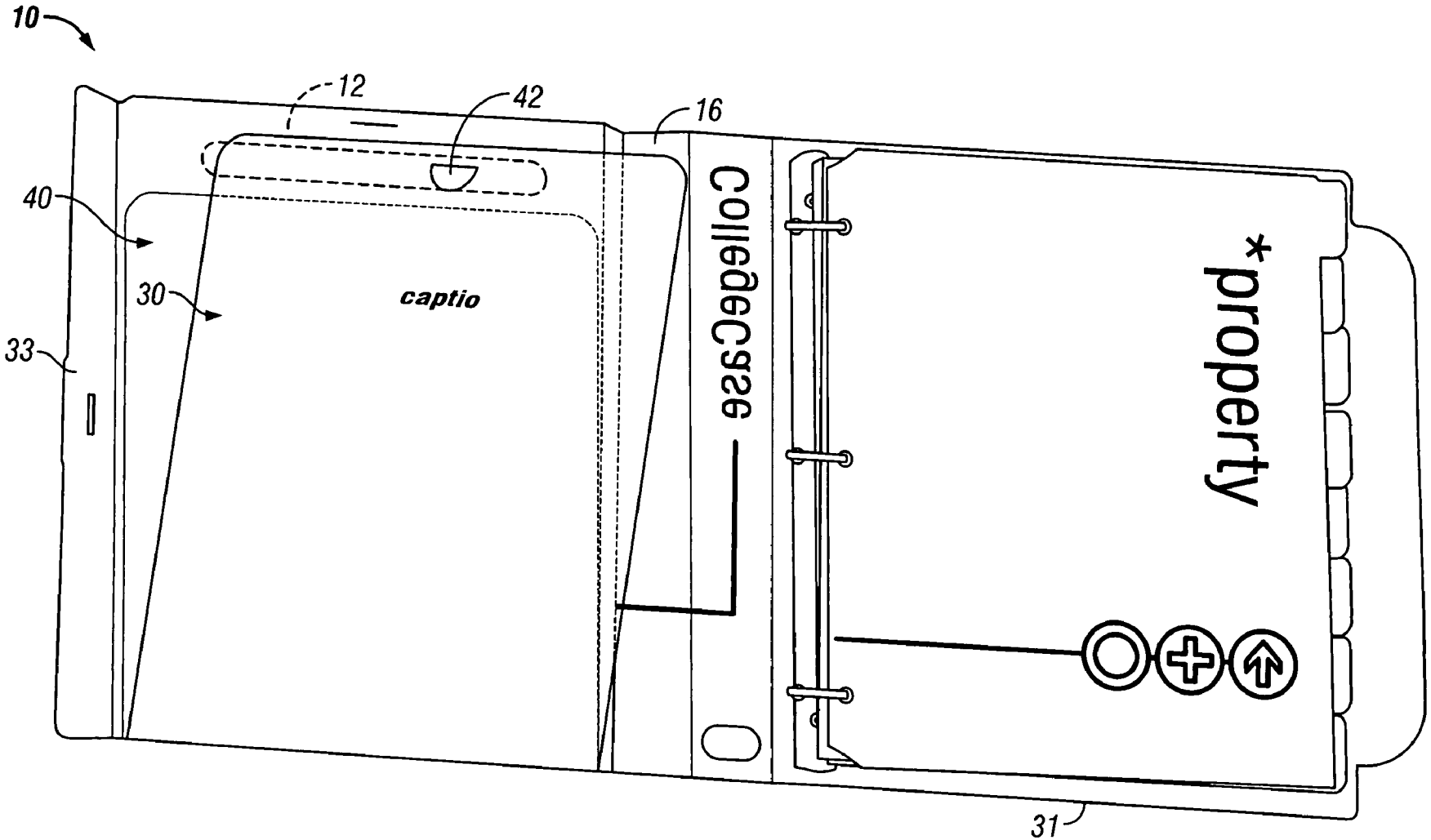
FIG. 4 is a perspective view of a binder showing access to a compartment via a hinged cover according to the invention.

FIG. 4 is a further perspective view of the binder according to preferred embodiment invention in which the cover 30 of the compartment is open revealing a space 40 therein. The cover includes a latching mechanism 42 to hold it in place until access to the compartment 40 is desired. The slot 12 formed through the front cover is shown as a dashed line. Thus, it is shown that the slot in the front cover provides a port which communicates to the compartment 40. The cover 42 encloses materials placed within the compartment until access is desired.

Those skilled in the art will appreciate that the cover 42 maybe hinged at the top as at the bottom shown but may be as well hinged at a side. The attachment means for holding the cover in place is a matter of choice. In the preferred embodiment, a matching tab and slot arrangement is provided. Further, the cover 42 maybe engaged in grooves and slide to open and close. Alternatively, the entire compartment may be opened, for example, where the compartment is held to the front cover by an edge with a releasable material, such as Velcro®.

Although the invention is described here with reference to preferred embodiments, one skilled in the art will appreciate that other applications may be substituted for those set forth here and without departing from the spirit and scope of the invention. For example, the invention is readily applicable to any such storage mechanism as a binder that provides access to information and temporary storage of key documents. Further, while the discussion herein focuses on management of finances, it is readily applicable to management and/or organization of other documents, such as those documents associated with travel arrangements, health care, or employment, For example, the invention can be used to store concert tickets or airline tickets. Further, while the preferred embodiment is constructed of such materials as polypropylene, it is readily constructed of any other materials that lend themselves to the invention, such as other plastics, metal, fibers, paper, cardboard, wood, leather, and the like. The binder and/or compartment may be translucent, opaque, transparent, or combinations thereof. The binder and the compartment may be modular, for example, comprising two or more separate units that are joinable and that may be readily separable. The binder and compartment may be comprised of two or more units that are joined and that may not be readily separable. Further, the binder may also be enclosed, or it may consist of a three-ring (or other) mechanism in an enclosed case. The compartment and slotted opening may be part of a unit that is retrofittable to existing binders, clipboards, and the like. The slotted opening to the compartments may be of any desired size, shape, and/or orientation.

Further, various uses may be made of the invention, which include, for example, managing all or part of a workflow; managing the affairs of a college student; processing time sensitive information; providing a document workflow for time-sensitive or other documents from a pending status to storage. For example the invention is readily used for:

- project management, such as home remodeling where the slotted compartment is used to hold literature or samples and the sleeves are organized by project steps;
- task management, such as paying bills where the slotted compartment is used to hold items that are used in conjunction with the task such as checkbook, calculator, stamps; and the sleeves are organized by category of payee; or
- information management, where the slotted compartment is used to hold information that is used to update the data recorded in the forms contained in a section, e.g. notice of a change in health insurance coverage; and the sleeves are organized by category of information.

Accordingly, the invention is limited only by the claims included below.

The invention claimed is:

1. A binder having a front and rear cover hingedly attached to a spine, said binder comprising:

- an opening, defined by any of said front cover and rear cover, and communicating to an interior of said binder, said opening comprising a slot having a substantially horizontal orientation, said slot having substantially parallel, horizontal edges extending linearly substantially across an upper portion of either of said binder front cover and rear cover, said slot having a width and height specifically adapted to receive documents introduced into the interior of said binder there through; and
- a compartment defined within said binder, wherein said slot communicates with said compartment within said binder, said compartment comprising an access and retention mechanism by which materials inserted through said opening drop into said binder and are retained within said compartment, and by which said materials are readily accessible from within said compartment.

2. The binder of claim 1, wherein any of said front cover, rear cover, spine, and compartment are constructed of any of plastic, metal, fiber, paper, cardboard, wood, and leather.

3. The binder of claim 1, wherein any of said front cover, rear cover, spine, and compartment are any of translucent, opaque, transparent, or combinations thereof.

4. The binder of claim 1, wherein said front cover, rear cover, and spine define a binder, and wherein said compartment is separately defined, said binder and said compartment being modular elements, comprising two or more separate units that are joinable and that may be readily separable.

5. The binder of claim 1, wherein said compartment and slotted opening are part of a unit that is retrofittable to an existing binder or clipboard.

6. The binder of claim 1, said binder configuration adapted to managing all or part of a workflow involving documents and information.

7. The binder of claim 6, wherein said workflow comprises any of:

project management;

task management; and information management.

* * * * *